United States Patent [19]

Zarges

[11] Patent Number: 4,643,312

[45] Date of Patent: Feb. 17, 1987

[54] STACKING SYSTEM

[76] Inventor: Frank Zarges, Bismarckstrasse 26, D-8130 Starnberg, Fed. Rep. of Germany

[21] Appl. No.: 727,401

[22] Filed: Apr. 25, 1985

[30] Foreign Application Priority Data

May 7, 1984 [DE] Fed. Rep. of Germany ..... 3416844

[51] Int. Cl.[4] ..... B65D 21/04

[52] U.S. Cl. ..... 206/514; 206/501; 206/507

[58] Field of Search ..... 206/501, 507, 514, 564, 206/518

[56] References Cited

U.S. PATENT DOCUMENTS

| | | | |
|---|---|---|---|
| 3,428,381 | 2/1969 | Schnur | 206/514 |
| 3,589,511 | 6/1971 | Britt | 206/564 |
| 3,883,037 | 5/1975 | Seiller | 206/507 |
| 4,079,077 | 3/1978 | David | 206/507 |
| 4,226,328 | 10/1980 | Beddow | 206/514 |
| 4,501,363 | 2/1985 | Isbey | 206/514 |

*Primary Examiner*—George E. Lowrance
*Attorney, Agent, or Firm*—Max Fogiel

[57] ABSTRACT

A stacking system consists of a tray-like component that accommodates articles in interior troughs and of a stacking component. The object is to provide a stacking system that can be adapted to different heights depending on the type of article being stored. The accommodating components can be stacked nested and the stacking components can be stacked nested. The top of an accommodating component engages the bottom of a stacking component and the top of each stacking component conforms to the bottom of each accommodating component. The distance between the top and bottom of each stacking component is independent of the height of any accommodating component.

17 Claims, 10 Drawing Figures

STACKING SYSTEM

BACKGROUND OF THE INVENTION

The present invention relates to a stacking system consisting of a tray-like component that accommodates articles in interior troughs and of a stacking component. Stacking systems of this type are employed in what is called ordered work-piece storage in conjunction with machine-tool operations involving automatic tool changing or with robots.

These stacking systems consist of stacking components in the form of an outer container and of components in the form of an inner container that accommodate the articles to be stacked and fit inside the stacking components. The inner container is employed to coordinate and order tool storage in such a way that the tools can be automatically removed from troughs in the container in a prescribed orientation.

The outer containers in systems of this type are stacked with the inner containers inside them and with their bottom resting on the edge of the outer container just below. Since the outer containers are all the same size, the free space above the articles in the inner container is unexploited when the articles are short in length and takes up room that could potentially be used for storage. The only way to avoid this situation is to provide a special outer container with specific measurements as well as an inner container that matches the articles being stored for each type of article. The drawback of keeping such a large number of different types of container on hand is obvious.

SUMMARY OF THE INVENTION

The object of the present invention is to provide a stacking system that can be adapted to different heights depending on the type of article being stored.

This object is attained in that the accommodating components can be stacked nested and the stacking components can be stacked nested with the top of an accommodating component engaging the bottom of a stacking component and the top of each stacking component conforming to the bottom of each accommodating component but with the distance between the top and bottom of each stacking component independent of the height of any accommodating component.

Essential to the invention accordingly is that the top of each accommodating component conform to the bottom of the stacking component just above it and its bottom to the top of the stacking component just below it, with each accommodating component resting on the top of the stacking component just below it with its top supporting the bottom of the stacking component just above it. This design makes it possible to stack articles without any dead space between them using only one size of stacking component and various types of accommodating component. Furthermore, both empty accommodating components and empty stacking components can be stacked nested with no dead space between them to save room.

In one embodiment of the invention the outer container can have at least three stacking corners that engage the bottom of the inner container. It can in particular have four stacking corners The stacking component can be an outer container that surrounds the accommodating component.

The outer container can have walls that taper into its floor and a stacking rim at least part of the way around its top and engaging the bottom of the accommodating component.

The walls of the outer container can have meandering recesses that extend to its floor with the areas without recesses serving as stacking corners The walls of the outer container can alternatively have recesses that extend perpendicular to its floor with the areas without recesses serving as stacking corners.

If it has recesses, the outer container can be rectangular in plan and the areas of its walls without recesses can be at its corners.

The accommodating component can be an inner container surrounded by the outer container.

The inner container can have an edge at least part way around it with the bottom functioning as a stacking support for the top of the outer container.

The top of the inner container can have an edge around it to accommodate the bottom of the outer container tightly, secured against lateral displacement.

The accommodating component can be deep-drawn or swaged with the troughs for the articles being accommodated molded in.

Some preferred embodiments of the invention will now be described with reference to the attached drawings, wherein

DESCRIPTION OF THE PREFERRED EMBODIMENTS

Figure 1:
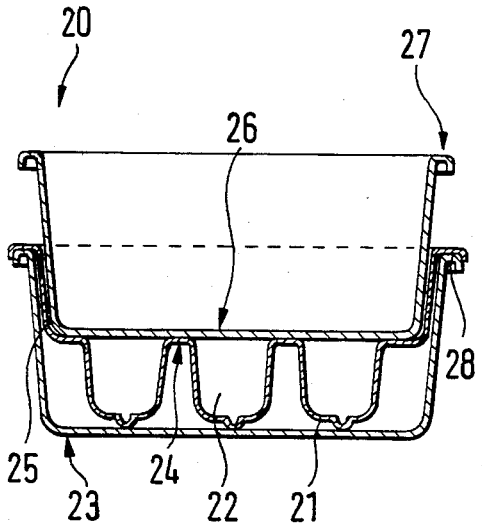
FIG. 1 illustrates a stacking system with an accommodating component and a stacking component accommodating articles of a specific height.
Figure 2:
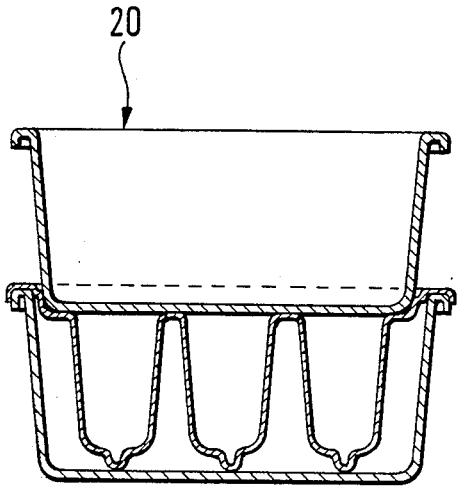
FIG. 2 illustrates a stacking system for accommodating higher articles.

A stacking system 20 consists of a tray-like component 21 in the form of an inner container that accommodates articles in interior troughs 22 and of a stacking component 23 in the form of an outer container. The tapering design of the illustrated embodiment allows the inner containers to be stacked together nested and the outer containers to be stacked together nested.

The top 24 of inner container 21 is designed to support the bottom 26 of outer container 23. An edge 25 that projects beyond the top 24 of inner container 21 at the side prevents lateral displacement of outer container 23.

The top 27 of outer container 23 conforms to the bottom 28 of inner container 21 in such a way that inner container 21 can be inserted in outer container 23 over these two—lateral—areas.

Articles can be stacked to a height that depends on their own height with no dead space in between and in outer containers 23 of identical dimensions by selecting inner containers 21 with troughs 22 of a depth appropriate to the height of the articles.

Figure 3:
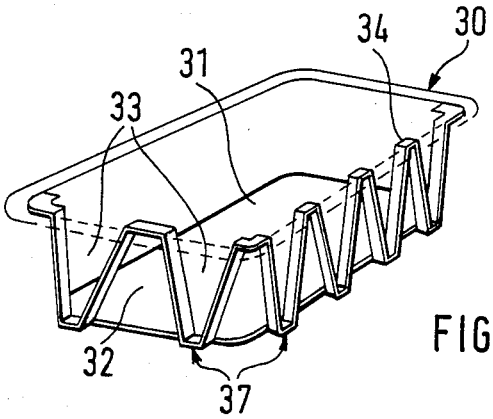
FIG. 3 is a perspective view of another embodiment of a stacking component in the form of an outer container without the accommodating component.

FIG. 3 illustrates an embodiment for an outer container 30 with conical walls 32 or tapered in relation to its floor 31 and have meandering recesses 33 that extend to the floor. The areas 32 without recesses serve as stacking corners. This embodiment enables nested stacking with other similar outer containers 30 while saving a maximum of space in terms of its floor 31 of outer container 30.

This embodiment of a stacking system employs an inner container 35 or 36. Its sides are positioned or rest on the—lateral—areas, the top 34, of outer container 30, which function as stacking corners. The bottoms 37 of the non-recessed walls 32 of outer container 30 fit tightly into the matching tops 38 of inner container 35. The bottoms 39 of inner container 35 itself rest on the tops 34 of the outer container 30 just below it. Troughs, not illustrated, can be positioned inside the outer container and above its floor 31 to accommodate the articles.

Figure 4:
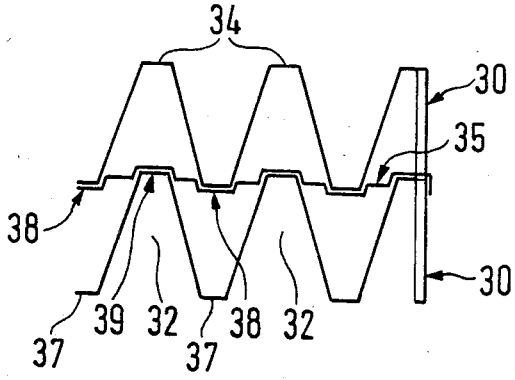
FIG. 4 is a partial schematic section through two stacking components of the type illustrated in FIG. 3 stacked on top of which other with one accommodating component.
Figure 5:
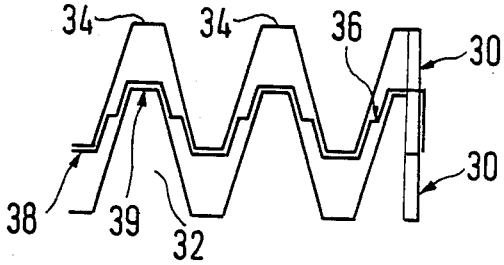
FIG. 5 is a view similar to that in FIG. 4 but with an accommodating component of a different stacking height.

FIG. 5 illustrates an inner container 36 that allows a lower stacking height than does the embodiment in FIG. 4.

Figure 6:
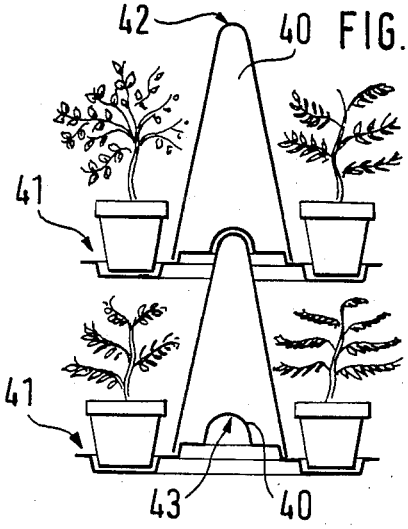
FIG. 6 is a schematic illustration of another embodiment of the stacking system.
Figure 8:
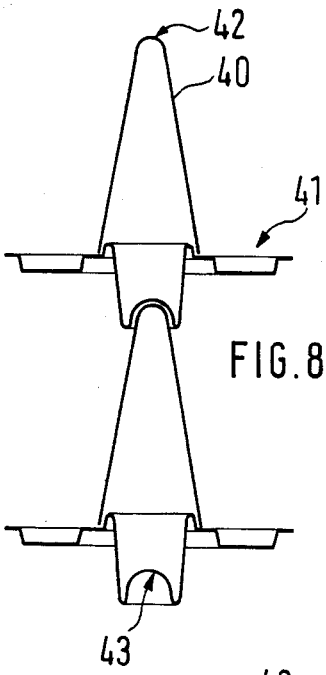
FIG. 8 shows the stacking system illustrated in FIG. 7 but with a different stacking height.
Figure 7:
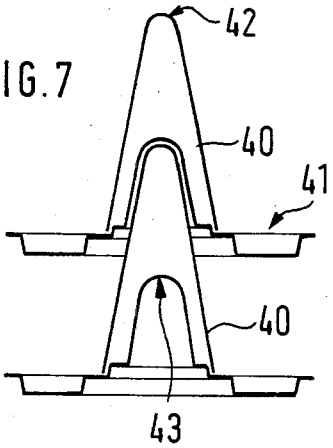
FIG. 7 shows the stacking system illustrated in FIG. 6 but with a different stacking height and without articles.
Figure 9:
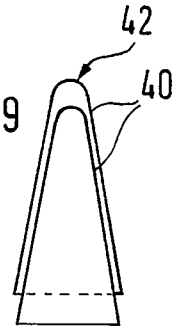
FIG. 9 is a schematic cross-section through stacking components stacked nested one inside another.
Figure 10:
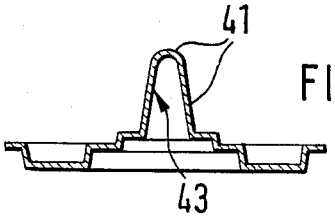
FIG. 10 is a schematic cross-section through accommodating components stacked nested one inside another.

FIG. 6 illustrates the simplest embodiment of the stacking system. It involves cap-like stacking components 40 and tray-like accommodating components 41 with troughs to accept the articles, flower pots in this case. Stacking components 40 can be stacked nested as illustrated in FIG. 9 and accommodating components 41 can be stacked nested as illustrated in FIG. 10. Since the top 42 of each stacking component 40 conforms to the bottom 43 of accommodating component 41, the stack will be tight and stable.

The height of the stack can be varied independently of the dimensions of stacking component 40 in accordance with the shape of the bottom 43 of the particular stacking component 40 employed.

I claim:

1. A stacking system comprising: a tray-shaped member with interior troughs for accommodating articles in said troughs, said tray-shaped member being stackably nested; a stacking member that can be stacked nested with the top of a tray-shaped member engaging the bottom of a stacking member, the top of each stacking member conforming to the bottom of each tray-shaped member, the distance between the top and bottom of each stacking member being independent of the height of any tray-shaped member, so that a plurality of tray-shaped members may be nested with stacking members to form a stack of tray-shaped members and stacking members, said stacking member having a height that can remain constant and need not be changed with varying inserted tray-shaped members, said tray-shaped member being fittable to said stacking member with said troughs having a height that only needs to be dependent on said articles and said tray-shaped member only needing to be changed.

2. Stacking system as defined in claim 1, wherein said stacking member has at least three stacking corners engaging the bottom of said tray-shaped member.

3. Stacking system as defined in claim 1, wherein said stacking member is an outer container surrounding said tray-shaped member.

4. Stacking system as defined in claim 3, wherein said outer container has walls tapering into its bottom and a stacking rim at least part of the way around its top and engaging the bottom of said tray-shaped member.

5. Stacking system as defined in claim 4, wherein said outer container has walls with meandering recesses extending to its bottom, areas of said walls without recesses serving as stacking corners.

6. Stacking system as defined in claim 4, wherein said outer container has a rectangular shape in top view, areas of said walls without recesses being at corners of said outer container.

7. Stacking system as defined in claim 1, wherein said tray-shaped member is an inner container surrounded by said stacking member, said stacking member comprising an outer container.

8. Stacking systems as defined in claim 7, wherein said inner container has an edge at least part way around it, the bottom of said inner container comprising a stacking support for the top of said outer container.

9. Stacking system as defined in claim 8, wherein the top of said inner container has an edge around it to accommodate the bottom of said outer container tightly and secured against lateral displacement.

10. Stacking system as defined in claim 1, wherein said tray-shaped member is deep-drawn or swaged with molded-in troughs for articles to be accommodated in said troughs.

11. Stacking system as defined in claim 1, wherein each trough has a height matching substantially the maximum height of said articles received in said troughs.

12. Stacking system as defined in claim 1, wherein said stacking member has a wall thickness greater than the wall thickness of said tray-shaped member.

13. Stacking system as defined in claim 1, wherein said stacking member has at least three stacking means engaging the bottom of said tray-shaped member.

14. Stacking system as defined in claim 1, wherein said troughs extend up to a maximum to the underside of said stacking member.

15. Stacking system as defined in claim 1, wherein said tray-shaped member has an upper side formed as a plane, said troughs having openings in said plane, said tray-shaped member having a rim above said plane, the bottom side of said tray-shaped member being formed on said rim.

16. Stacking system according to claim 1, wherein undersides of said troughs are supported by the underside of said stacking member.

17. A stacking system comprising: a tray-shaped member with interior troughs for accommodating articles in said troughs, said tray-shaped member being stackably nested; a stacking member that can be stacked nested with the top of a tray-shaped member engaging the bottom of a stacking member, the top of each stacking member conforming to the bottom of each tray-shaped member, the distance between the top and bottom of each stacking member being independent of the height of any tray-shaped member, so that a plurality of tray-shaped members may be nested with stacking members to form a stack of tray-shaped members and stacking members, said stacking member having a height that can remain constant and need not be changed with varying inserted tray-shaped members, said tray-shaped member being fittable to said stacking member with said troughs having a height that only needs to be dependent on said articles and said tray-shaped member only needing to be changed; said stacking member being an outer container surrounding said tray-shaped member; said outer container having walls tapering into its bottom and a stacking rim at least part of the way around its top and engaging the bottom of said tray-shaped member; said outer container having walls with meandering recesses extending to its bottom, areas of said walls without recesses serving as stacking corners; said tray-shaped member being an inner container surrounded by said stacking member; said inner container having an edge at least part way around it, the bottom of said inner container comprising a stacking support for the top of said outer container; the top of said inner container having an edge around it to accommodate the bottom of said outer container tightly and secured against lateral displacement; said tray-shaped member being deep-drawn or swaged with molded-in troughs for articles to be accommodated in said troughs; each trough having a height matching substantially the maximum height of said articles received in said troughs; said stacking member having a wall thickness greater than the wall thickness of said tray-shaped member; said stacking member having at least three stacking means engaging the bottom of said tray-shaped member; said troughs extending up to a maximum to the underside of said stacking member; said tray-shaped member having an upper side formed as a plane, said troughs having openings in said plane, said tray-shaped member having a rim above said plane, the bottom side of said tray-shaped member being formed on said rim; undersides of said troughs being supported by the underside of said stacking member.

* * * * *